US009988878B2

(12) United States Patent
Ali et al.

(10) Patent No.: US 9,988,878 B2
(45) Date of Patent: Jun. 5, 2018

(54) ONE TRIP CLEANING AND TOOL SETTING IN THE CLEANED LOCATION

(71) Applicant: BAKER HUGHES INCORPORATED, Houston, TX (US)

(72) Inventors: Mohsen Ali, Houston, TX (US); Levi B. Oberg, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 405 days.

(21) Appl. No.: 14/691,802

(22) Filed: Apr. 21, 2015

(65) Prior Publication Data

US 2016/0312582 A1 Oct. 27, 2016

(51) Int. Cl.
*E21B 37/02* (2006.01)
*E21B 33/12* (2006.01)

(52) U.S. Cl.
CPC ..... *E21B 37/02* (2013.01); *E21B 33/12* (2013.01)

(58) Field of Classification Search
CPC ..... E21B 37/00; E21B 37/02; E21B 37/04; E21B 37/045; E21B 33/12; E21B 33/1295; E21B 33/134; E21B 23/004; E21B 23/006; E21B 37/06
USPC ..... 166/311, 173, 172, 174
See application file for complete search history.

(56) References Cited

U.S. PATENT DOCUMENTS 6,152,221 A * 11/2000 Carmichael ..... E21B 37/02 15/104.16
7,048,055 B2 * 5/2006 Hirth ..... E21B 33/12 166/118
7,121,343 B2 * 10/2006 Telfer ..... E21B 37/02 166/174
7,191,835 B2 * 3/2007 Howlett ..... E21B 29/00 166/311
7,513,303 B2 4/2009 Hern
8,141,627 B2 * 3/2012 Krieg ..... E21B 37/02 166/172
8,387,700 B2 3/2013 Hern
8,408,307 B2 * 4/2013 Telfer ..... E21B 21/103 166/170
8,511,375 B2 8/2013 Hern et al.
9,435,176 B2 * 9/2016 Bansal ..... E21B 37/00
2001/0040035 A1 * 11/2001 Appleton ..... E21B 37/02 166/387
2009/0272524 A1 11/2009 Voth
2011/0168404 A1 7/2011 Telfer et al.
(Continued)

*Primary Examiner* — Michael R Wills, III
(74) *Attorney, Agent, or Firm* — Steve Rosenblatt

(57) ABSTRACT

A combination tool allows delivery of a tool such as a packer or bridge plug with a variety of well cleanup tools that are retracted for running in. Once in the vicinity of where the plug or packer is to be set or if an internal diameter is to be targeted using clean up tools after passing a restriction, an inner mandrel can be activated such as in conjunction with a j-slot to selectively extend one or more cleaning tools against the force of a return spring out though openings in an outer housing. Circulation is established either through an open port or by opening a circulation port with mandrel movement. Just the zone near where the packer or bridge plug is to be set is cleaned. The cleaning tools retract after use with further mandrel movement. The packer or plug is picked up into position and set and the bottom hole assembly is removed. The plug or packer can be set in a variety of ways.

35 Claims, 1 Drawing Sheet

(56) References Cited

U.S. PATENT DOCUMENTS

| | | | | |
|---|---|---|---|---|
| 2011/0186355 | A1* | 8/2011 | Telfer | E21B 37/02 175/57 |
| 2011/0240058 | A1* | 10/2011 | Jonassen | B08B 9/0436 134/8 |
| 2012/0211229 | A1 | 8/2012 | Fielder et al. | |
| 2012/0222861 | A1 | 9/2012 | Eriksen | |
| 2014/0246239 | A1 | 9/2014 | Abdel-Baky | |
| 2014/0262277 | A1* | 9/2014 | Meeks | E21B 23/006 166/301 |
| 2015/0027780 | A1 | 1/2015 | Hern et al. | |
| 2016/0061006 | A1* | 3/2016 | Krueger | E21B 37/02 166/174 |

* cited by examiner

ONE TRIP CLEANING AND TOOL SETTING IN THE CLEANED LOCATION

FIELD OF THE INVENTION

The field of the invention is methods for cleaning a hole in the intended location for setting a tool and more particularly where the cleaning can be selectively accomplished in the vicinity of where the tool is to be set in the same trip as the setting of the tool in the cleaned location.

BACKGROUND OF THE INVENTION

Saving trips into the hole saves time and money. For that reason service companies have been emphasizing one trip tools that combine tasks. Restrictions through which such tools have to traverse makes the creation of multi-function tools very challenging. In essence simplicity of design is made necessary by the limited space available and yet design durability and the harsh environmental conditions can at times dictate a more robust component design. These design and operational requirements can be at odds. Some designs that work well in reasonably vertical wells are not so advantageous and at times unworkable in highly deviated applications. In addition, advanced cleanup tools with proven track record in the industry usually operate within the parameters of the casing drift and passing through restrictions to expand and target a casing internal diameter is not an option.

Tubular cleaning is typically done in a separate trip with devices such as blades, brushes or magnets. Typically these tools have picoting members that are extended with flow or pressure and have a spring return to keep the cleaning tools retracted for running in. One example of integrating scraping and drilling is shown in US 2015/0027780. In this reference a drill bit is run through existing casing to make more hole through a formation that can leave a fair amount of debris on the existing casing as the returns are brought to the surface. The tool combines scrapers that can be extended as the bit is brought out from the hole to clean the length of the casing on the way out. This is done with balls landing on a sleeve to extend the scrapers and to open a circulation port. In this design drilling is done before the circulation port opens because pressurized fluid to the bit nozzles can no longer be provided with the circulation port open above the bit. The scraping continues as the bit moves out of the hole.

References that show scrapers, brushes and magnets are U.S. Pat. No. 7,513,303, U.S. Pat. No. 8,387,700 and U.S. Pat. No. 8,511,375. These patents show similar ideas of clean up assemblies, but do not have the option to expand and retract.

There are other applications that lend themselves to one trip operations to save time and money. One of those is the plugging of a well with a bridge plug for abandonment. Current regulations specify procedures for abandoning wells that involve inserting and setting a plug such as a bridge plug or a cement plug or both. The current state of the art in this procedure is an initial trip to clean up the hole before setting a bridge plug for isolation. The present invention incorporates in a single trip the ability to deploy one or more wellbore cleanup tools such as scraper blades, brushes or magnets and selectively deploy them with a ported sub open. Just the intended region where the bridge plug is to be set is cleaned. The cleaning tools are retracted and the bridge plug is positioned at the desired depth in the zone already cleaned. The bridge plug is then set in a variety of ways such as mechanically, hydraulically or with a known setting tool that can be wireline operated. These and other aspects of the present invention will be more readily apparent to those skilled in the art from a review of the description of the preferred embodiment and the associated drawings while recognizing that the full scope of the invention can be determined from the appended claims.

SUMMARY OF THE INVENTION

A combination tool allows delivery of a tool such as a packer or bridge plug with a variety of well cleanup tools that are retracted for running in. Once in the vicinity of where the plug or packer is to be set, or if an internal diameter is to be targeted using clean up tools after passing a restriction, an inner mandrel can be activated such as in conjunction with a j-slot to selectively extend one or more cleaning tools against the force of a return spring out though openings in an outer housing. Circulation is established either through an open port or by opening a circulation port with mandrel movement. Just the zone near where the packer or bridge plug is to be set is cleaned. The cleaning tools retract after use with further mandrel movement. The packer or plug is picked up into position and set and the bottom hole assembly is removed. The plug or packer can be set in a variety of ways.

DETAILED DESCRIPTION OF THE PREFERRED EMBODIMENT

Figure 1:
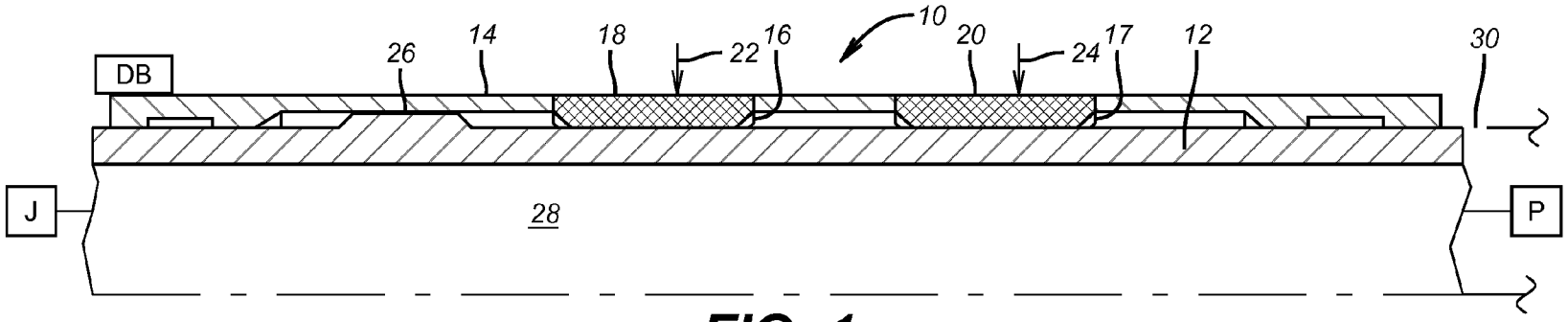
FIG. 1 is a section view of the tool in a run in position.
Figure 2:
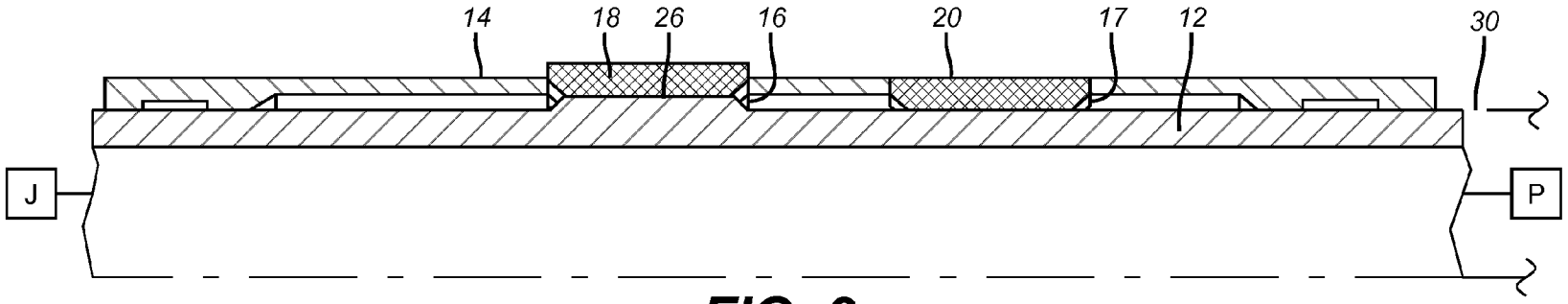
FIG. 2 is the view of FIG. 1 showing a first cleaning tool extended with mandrel movement.
Figure 3:
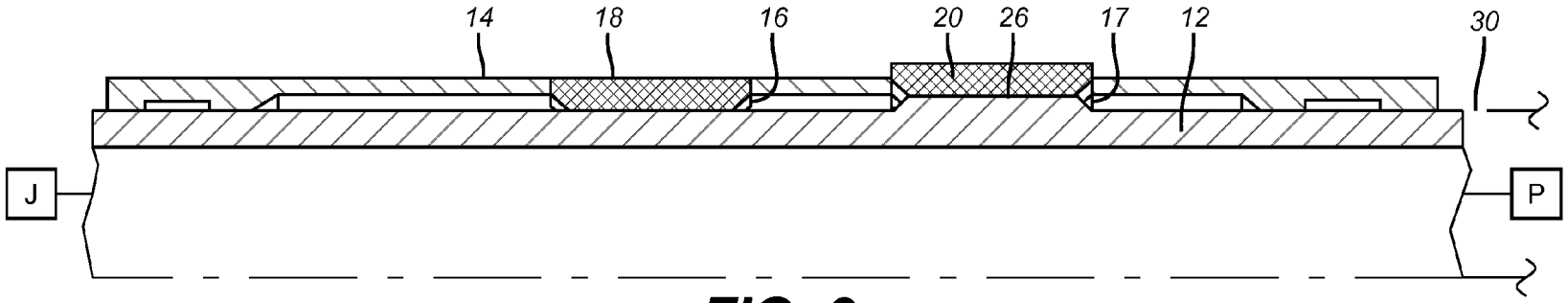
FIG. 3 is the view of FIG. 2 with another cleaning tool extended.

FIG. 1 illustrates an assembly 10 having a mandrel 12 in an outer housing 14 that has axially spaced openings 16 and 17 through which are extendible cleaning devices 18 and 20 that are biased inwardly toward mandrel 12 as schematically illustrated by arrows 20 and 24. Preferably the openings 16 and 17 are axially aligned between adjacent rows to provide flow channels for circulating fluid when the cleaning devices 18 and 20 are both extended together. Cleaning devices or members 18 and 20 can also be extended one row at a time. The mandrel 12 is relatively movable with respect to the outer housing 14 with one way such relative movement can be accomplished is holding the outer housing 14 to a surrounding tubular that is not shown using drag blocks DB and manipulating the mandrel 12 using a j-slot mechanism J. FIGS. 2 and 3 show different relative positions of the raised surface 26 under device 18 and overcoming bias force 22 and then the raised surface 26 moving to under device 20 to overcome bias force 24 for sequential extension of devices 18 and 20.

Device 18 could be brushes and device 20 could be scraping members with exterior profiles and hardened components to release caked on debris from a surrounding tubular. Although two different devices are shown, fewer or greater numbers of devices can be used that are either all the same or all different or with some duplication to act as spares. Mandrel profiles such as 26 can occur singly to extend a single row of devices at a time or can have multiple raised surfaces 26 so that more than a single row of devices are extended at a given time. While the cleaning devices can be forced out by a raised surface such as 26 there are other ways such as using magnets in the mandrel 12 that align opposed poles with magnets on the back of the devices to be repelled so that the devices are extended. In any given row of devices there can be one or more than one device and where there is more than one device in a single row the devices in that row can be the same or different. The devices can also be magnets to grab any magnetic debris clinging to the wall of a surrounding tubular that is not shown. The cleaning of a particular location can be accomplished with reciprocal axial movements of the mandrel 12 with the outer housing 14 or with tandem rotation while fluid circulates through passage 28 through lateral ports 30 to help in circulating out some of the debris that is dislodged by the cleaning devices.

After the cleaning is completed for a short zone whose location can be determined with casing collar locators or other tools known to communicate depth of the bottom hole assembly, the packer P is positioned in the zone just cleaned and set in a variety of known ways. Some of those ways can be with mechanical manipulation of the string, with a powered setting tool or with applied pressure if the ports 30 are closed off. The packer P is then released and the running string that is not shown pulls the mandrel 12 and the outer housing 14 away from the packer P and to the surface so that the well abandoning process can be completed.

Although a packer P is schematically illustrated, other types of tools are contemplated such as anchors with associated other tools or bridge plugs. The advantage of the method is that the cleaning devices can be extended and retracted multiple times and are preferably biased to retract with leaf springs or the like. Only a short section of the wellbore is cleaned and in the same trip as the running in of a tool that will ultimately be set in the cleaned zone. The actuation system for the cleaning devices is simple and reliable using drag blocks and a j-slot mechanism however other devices that selectively place an actuation device by a cleaning device could also be used, such as magnets that have been previously mentioned. The cleaning devices are released from the set packer or plug or other tool and retrieved in a retracted condition to the surface of the borehole. Typically, clean up assemblies include brushes, scrapers or magnets and these assemblies will be used with the mechanism mentioned above. The cleanup tools such as scrapers and magnets can be retracted to pass through restrictions. The cleanup tools can then be extended with pressure or mechanical manipulation to clean a larger diameter that exists beyond the tubing through which the tools were initially delivered and that represent the location of the setting of the plug that has also passed through existing tubing to the set location.

The above description is illustrative of the preferred embodiment and many modifications may be made by those skilled in the art without departing from the invention whose scope is to be determined from the literal and equivalent scope of the claims below:

We claim:

1. A completion method for a subterranean location, comprising:

actuating a cleaning assembly run with a bottom hole assembly of a tool to clean a portion of an existing tubular that defines a borehole to a subterranean location;

positioning said tool in said cleaned portion;

actuating said tool in said cleaned portion;

releasing said cleaning assembly after said actuating of said tool.

2. The method of claim 1, comprising:

retracting said cleaning assembly after extending said cleaning assembly for said cleaning of a portion of said tubular.

3. The method of claim 2, comprising:

removing said cleaning assembly from the subterranean location in a retracted position.

4. The method of claim 1, comprising:

biasing said cleaning assembly toward a retracted position in an outer housing of said bottom hole assembly.

5. The method of claim 1, comprising:

actuating said cleaning assembly with relative movement of a mandrel with respect to an outer housing of said bottom hole assembly, said outer housing having at least one opening through which said cleaning assembly selectively extends.

6. The method of claim 5, comprising:

aligning at least one projection on said mandrel with at least one cleaning member of said cleaning assembly to forcibly push said cleaning member through said opening.

7. The method of claim 6, comprising:

using said at least one projection to overcome bias on said at least one cleaning member when pushing said cleaning member through said at least one opening.

8. The method of claim 7, comprising:

providing multiple openings as said at least one opening in at least one row with each opening having an associated cleaning member.

9. The method of claim 8, comprising:

making said cleaning members the same or different in said at least one said row.

10. The method of claim 9, comprising:

making said at least one row a plurality of rows.

11. The method of claim 10, comprising:

axially aligning openings in adjacent rows to provide flow channels for fluid delivered through said outer housing taking debris to a surface location when cleaning members in multiple rows are extended through respective openings.

12. The method of claim 10, comprising:

sequentially extending cleaning members in one row after allowing cleaning members previously extended in another said row to retract under said bias.

13. The method of claim 12, comprising:

making at least some of said cleaning members scrapers, brushes or magnets.

14. The method of claim 13, comprising:

providing a packer or bridge plug as said tool.

15. The method of claim 5, comprising:

aligning at least one magnet on said mandrel with at least one cleaning member of said cleaning assembly to forcibly push said cleaning member through said opening.

16. The method of claim 5, comprising:

extending and retracting said cleaning assembly with only radial movement.

17. The method of claim 5, comprising:

initiating circulation through a port in said outer housing for debris removal from the subterranean location during said actuation said cleaning assembly.

18. The method of claim 17, comprising:

opening said port during said actuation of said cleaning assembly.

19. The method of claim 18, comprising:

closing set port after said opening of said port to allow pressure buildup in said mandrel for setting said tool;

providing a packer or bridge plug as said tool.

20. The method of claim 1, comprising:

providing a packer or bridge plug as said tool.

21. A tool assembly for subterranean use, comprising:

a selectively actuated cleaning device for contact with a surrounding borehole wall for cleaning thereof, said cleaning device is releasably mounted on a bottom hole assembly comprising a selectively actuated tool, said cleaning device selectively released from said selectively actuated tool after said selectively actuated tool is actuated in a location of said borehole wall cleaned by said cleaning device for removal of said cleaning device from the borehole.

22. The assembly of claim 21, wherein:

said cleaning device is retracted from contact with the surrounding borehole wall to facilitate removal therefrom.

23. The assembly of claim 21, further comprising:

a biasing member to selectively retain said cleaning device in a retracted position away from the borehole wall.

24. The assembly of claim 21, wherein:

said cleaning device is actuated by relative movement between a mandrel supporting said cleaning device and an outer housing having at least one opening for selective extension of a cleaning element of said cleaning device through said at least one opening toward the borehole wall.

25. The assembly of claim 24, wherein:

at least one projection on said mandrel to forcibly push said cleaning element through said at least one opening.

26. The assembly of claim 25, wherein:

said at least one projection overcoming a force from at least one biasing member for extension of said cleaning element through said at least one opening.

27. The assembly of claim 26, wherein:

as said at least one opening comprises multiple openings in at least one row with each opening having an associated cleaning member.

28. The assembly of claim 27, wherein:

said at least one row comprises a plurality of rows and at least one row has cleaning elements that are all the same size or of different sizes.

29. The assembly of claim 28, wherein:

said openings in adjacent rows are axially aligned to provide flow channels for fluid delivered through said outer housing to take debris to a surface location when cleaning elements in multiple rows are extended through respective openings.

30. The assembly of claim 28, wherein:

said cleaning elements in one row are extended after cleaning elements previously extended in another said row are forced to retract under bias from said at least one biasing member.

31. The assembly of claim 30, wherein:

at least some of said cleaning members comprise scrapers, brushes or magnets.

32. The assembly of claim 31, wherein:

said tool further comprises a packer or a bridge plug.

33. The assembly of claim 24, wherein:

said at least one cleaning element is selectively forced through a respective at least one opening with alignment of a magnet with said cleaning element.

34. The assembly of claim 24, wherein:

said at least one cleaning element movable radially for extension and retraction through a respective said at least one opening.

35. The assembly of claim 24, wherein:

said outer housing comprising a selectively opened port for circulation when said cleaning element is extended, said port subsequently closed to allow pressure to be directed to said tool for actuation thereof, said tool further comprising a packer or a bridge plug.

* * * * *